United States Patent [19]

Brill et al.

[11] Patent Number: 4,789,582

[45] Date of Patent: Dec. 6, 1988

[54] HEAT RETENTION DEVICE FOR WINDOWS, DOORS AND THE LIKE

[75] Inventors: Klaus Brill, Korntal; Wolfgang Grothe, Tiefenbronn, both of Fed. Rep. of Germany

[73] Assignee: Robert Bosch GmbH, Stuttgart, Fed. Rep. of Germany

[21] Appl. No.: 670,114

[22] Filed: Nov. 8, 1984

Related U.S. Application Data

[63] Continuation of Ser. No. 474,591, Mar. 11, 1983, abandoned.

[30] Foreign Application Priority Data

Jul. 18, 1981 [DE] Fed. Rep. of Germany ..... 3128487

[51] Int. Cl.[4] ..... B32B 15/08

[52] U.S. Cl. ..... 428/136; 428/137; 160/237; 160/330

[58] Field of Search ..... 428/136, 137; 160/237, 160/330

[56] References Cited

U.S. PATENT DOCUMENTS

| | | | |
|---|---|---|---|
| 2,238,422 | 4/1941 | Marcin | 160/237 |
| 3,065,785 | 11/1962 | Taber | 160/237 |
| 3,811,239 | 5/1974 | Becker | 428/137 X |
| 3,968,287 | 7/1976 | Balk | 428/137 X |
| 4,158,718 | 6/1979 | Kehl et al. | 428/461 |

FOREIGN PATENT DOCUMENTS

| | | | |
|---|---|---|---|
| 178460 | 7/1964 | U.S.S.R. | 160/355 |
| 606862 | 8/1948 | United Kingdom | 160/237 |

*Primary Examiner*—Nancy A. B. Swisher

*Attorney, Agent, or Firm*—Frishauf, Holtz, Goodman & Woodward

[57] ABSTRACT

A heat-retention device for windows, doors or the like is proposed, in the form of a curtain (10) or roller shade, which has a plastic foil as a carrier, to which at least one vapor-deposited or atomized metal coating having a high reflective capacity in the long-wave heat radiation range is applied. The plastic foil is subdivided at least in some areas, for instance by perforation (11) or by the joining together of narrow strips (15, 16), in order to alter its mechanical properties with a view to reducing its elasticity. The result is a structure which is substantially better and esthetically more pleasing when used in the form of curtains or roller shades.

13 Claims, 2 Drawing Sheets

HEAT RETENTION DEVICE FOR WINDOWS, DOORS AND THE LIKE

This application is a division of application Ser. No. 474,591, filed Mar. 11, 1983, now abandoned.

The invention is based on a heat-retention device for windows, doors and the like in the form of a curtain or roller shade, having a plastic film as a carrier and having at least one coating, which has a high reflective capacity for heat radiation from the interior of the room. A heat-retention device of this kind is known in principle from German Examined Published Application DE-AS No. 2,703,688 and corresponding U.S. Pat. No. 4,158,718, where a protective device for light-transmissive, closed window or door openings is described. This known heat-protection device is also supposed to be usable such that it is suspended freely and loosely at a distance from a window or door opening in the manner of a roller-shade web or a curtain, but this is only conditionally possible. Although the known heat-retention device has the same object, that is, to reflect long-wave radiation emitted from the interior of a room toward the windows or doors or in other words to prevent the loss of heat to the outside, there arc some important hindrances to the use of the known foil directly as a curtain or roller shade, resulting from the mechanical properties of the plastic foil or of the coating. The known foil, in particular a polyester foil which is preferably used for technical and visual reasons, does not drape like fabric; instead, because of its elasticity, it does not hang in folds. Furthermore, the known heat-protection foil does not remain entirely smooth, which is a consequence of its being fastened and held at the edge and causes visually unattractive bulges. The foil flutters in drafts, causing disruptive reflexes. Furthermore, soiling is easily seen, whether on the coating or on the uncoated side of a smooth foil, which is especially disadvantageous since the foil cannot be cleaned as can a window pane or a fabric curtain.

ADVANTAGES OF THE INVENTION

The heat-retention device according to the invention and having the plastic foil subdivided, at least in some areas, in order to alter its mechanical properties, overcomes the disadvantages described above and makes it possible to use a heat-protection foil known per se, for instance a polyester foil having a vapor-deposited or atomized metal coating or a coating of indium oxide, in an esthetically pleasing form and without disruptive secondary effects inside buildings in the manner of a curtain or a roller shade; as a result, the field of application of energy-saving heat-protection foils is broadened significantly.

By means of perforating the foil or narrowing it into strips, advantageous embodiments of the heat-retention device having the aforementioned subdivisions of the foil are possible. Embodiments which have proved to be particularly advantageous are, on the one hand, a plastic foil perforated preferably in a striped pattern and, on the other, a heat-retention device produced by combining individual strips together. In the case of a plastic foil perforated in a striped pattern, the mechanical properties required for use as a roller shade or curtain are attained by the reduction of elasticity in the area of the perforations. In the case of a mat made up of plastic foil strips, which can be manipulated like a fabric curtain, the elastic restoring forces in the foil are reduced to such an extent that the problems described above no longer occur. An advantageous and particularly economically produceable compromise between a known, one-piece heat-protection foil and a heat-retention device made up of individual strips is attained by partially decreasing the mechanical cohesion of the plastic foil by removing material or compressing it by stamping, resulting in a device which has properties similar to those of the device made up of joined strips.

DRAWING

Exemplary embodiments of the invention are shown in the drawing and will be described in further detail in the following section. Shown are:

FIG. 1, a curtain-like heat-retention device having vertical perforation areas;

FIG. 2, an enlarged illustration of a device according to FIG. 1 having folds formed in the area of the perforation strips;

FIG. 3, a heat-retention device in the form of a mat of interwoven individual strips; and FIG. 4, a curtain-like embodiment having foil strips woven into a wide-mesh fabric curtain.

DESCRIPTION OF THE EXEMPLARY EMBODIMENTS

Figure 1:
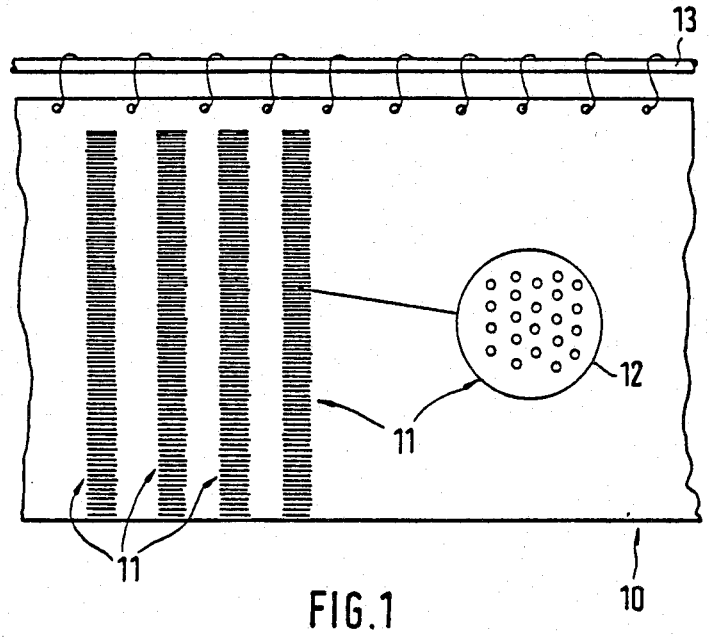

FIG. 1, in schematic form, shows a curtain 10 having stripe-like perforation areas 11 extending vertically. The perforation is also shown in enlarged form in the detail 12. The diameter of the holes and the spacing between them within the perforation 11 are on the order of magnitude of 1 mm. The width of and distances between the vertically extending perforated areas 11 are between 20 mm and 100 mm. The curtain 10 may be secured in any arbitrary manner on a curtain rod 13 or may be wound up in the manner of a roller shade.

Figure 2:
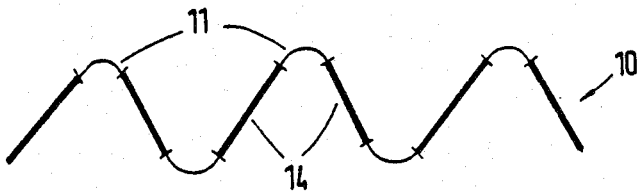

On an enlarged scale, FIG. 2 shows the formation of folds in the curtain 10, with bends in the vicinity of the perforation 11. The non-perforated areas 14, because of their rigidity and elasticity, remain substantially flat.

Figure 3:
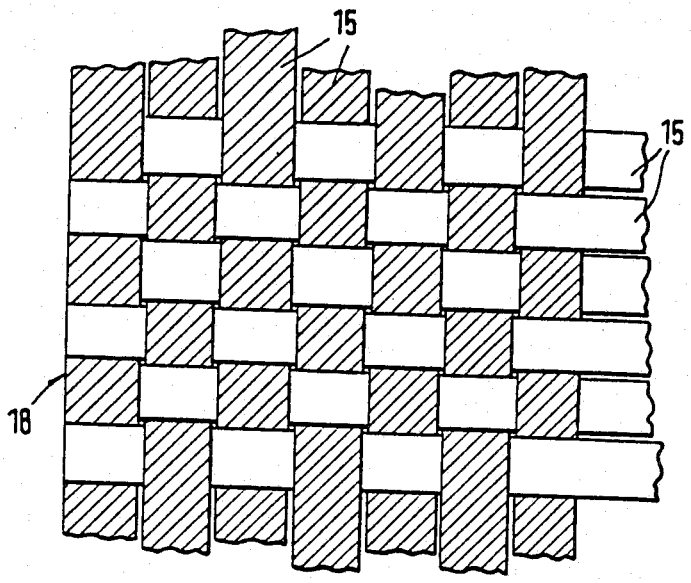

FIG. 3 shows a heat-retention device in which the plastic foil, cut apart into strips 15, is joined by interweaving to make a mat. In order to show the pattern more clearly, the vertically extending strips 15 are shaded in the drawing; technically, however, the vertical and the horizontal strips 15 are all identical. The strips 15 have a width of approximately 3 to 15 mm; however, if needed, it is also possible to use even narrower or substantially wider strips, depending on the size of the completed device.

Figure 4:
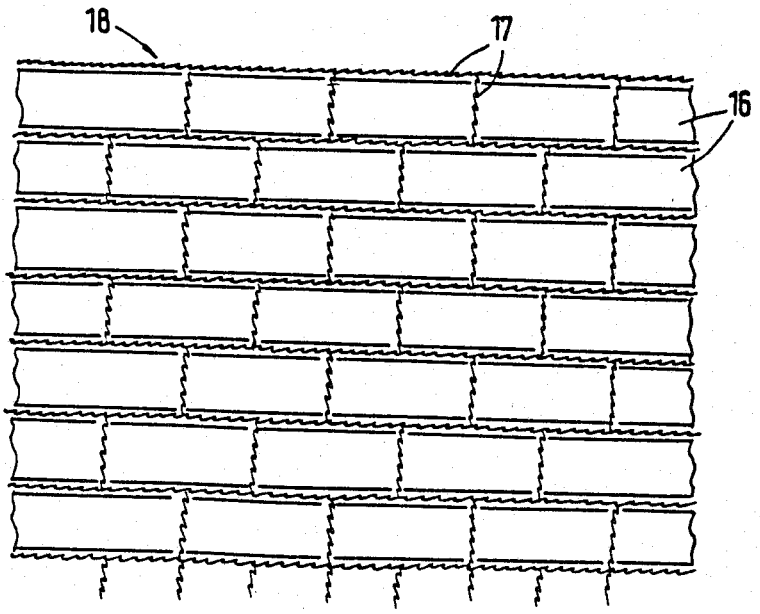

A further alternative way of realizing the heat-retention device according to the invention is shown in FIG. 4. Here, strips 16 of the coated plastic foil are interlaced with a wide-mesh fabric curtain 17, resulting in a device which is particularly pleasing esthetically. The foil strips 16 and the curtain 17 are welded or glued to one another, depending on the materials used, in the peripheral zones 18.

A further alternative for realizing the heat-retention device according to the invention, not shown in the drawing but similar in appearance to the embodiment of FIG. 4, is offered by partially decreasing the mechanical cohesion of the plastic foil, either by removing material or by compressing it through stamping. Here again, areas of severely reduced elasticity and thus substantially weaker restoring forces are produced, so that a device of this kind, which is particularly economical to manufacture, can also be manipulated in the manner of a curtain or roller shade.

Because of the subdivision, at least in some areas, of the heat-retaining plastic foil (which is known per se) according to the invention, a change in the mechanical properties of the foil is attained, with the result that in predetermined areas this foil becomes intentionally deformable to make it more manipulable. The mechanical properties are affected such that draping similar to that in a fabric curtain becomes possible. By means of a perforation, or by making an appropriate subdivision of the entire surface area, the transmission of the forces causing fluttering of the foil is also prevented. In the device according to FIG. 1, the rows of holes and the hole sizes are selected such that the desired effect is attained intentionally, without an attendant excessive restriction in the heat-protective effect. Instead of vertical rows of holes, horizontal or diagonal ones may be used for technical or esthetic reasons; this may be more favorable for roller shades, for instance, and can also bring about other decorative effects. The holes of the perforations may be created by a mechanical process such as stamping, or by electron or laser beams, as an example.

In the devices according to FIGS. 3 and 4, the elastic restoring forces are very severely reduced in comparison with a one-piece foil and are transmitted to only a limited extent by frictional forces. Besides the two devices shown in FIGS. 3 and 4, other methods for producing mat-like forms are possible; for instance, the mats can be produced by weaving processes, by sewing or by welding or gluing or other bonding techniques. In the device according to FIG. 4, a very fabric-like appearance is attained, which is advantageous for esthetic reasons, particularly for household uses. The mesh size and strip width are freely selectable within wide limits, although with an increasing strip width the draping qualities and plastic deformability are lessened. A fact of importance in terms of the method for producing the heat-retention device according to the invention is that the plastic foil can be coated in a continuous process. Subsequently, the mechanical cohesion of the foil is partially decreased by perforating, cutting or stamping it. The sequence of the operations of coating and reducing the mechanical cohesion can be reversed, however; that is, the mechanically complete mat can then be provided with the heat-protective coating. The processing of the heat-retention device according to the invention can be accomplished on apparatus intended for mass production. The disadvantages of known foils discussed at the outset above no longer occur; in particular, fluttering, disruptive reflexes, poor manipulability, readily-perceived soiling and the unsatisfactory visual impression either disappear or are at least reduced to an insignificant amount. The coating system of the heat-protective foil can be selected in accordance with the intended application; in particular, protective coatings of paint or polymer coatings may be applied, for example, as can additional reflection-reducing coatings. For the realization of the heat-retention device according to the invention, the design of the coating is of secondary importance, and like the material and thickness of the carrier foil can be balanced out by the appropriate dimensioning of the provisions for subdivision of the material.

We claim:

1. A heat retention device, comprising a plastic foil carrier transparent to visible light and subdivided in at least some areas into alternating perforated (11) and non-perforated (14) areas in order to alter its mechanical properties, an atomized metal coating, reflective to long-wave heat radiation, deposited on said foil carrier, and means (13) for hanging said device in proximity to a vertical surface, wherein, in accordance with the invention, the plastic foil is perforated (11) in a striped pattern (FIG. 1) in order to create curtain-like folds in the vicinity of said perforations (FIG. 2) when it is hung.

2. A heat-retention device as defined by claim 1, characterized in that the width of as well as the distance between the perforated areas (11) are between 20 mm and 100 mm.

3. A heat retention device comprising a plastic foil carrier transparent to visible light and subdivided in at least some areas to alter its mechanical properties, an atomized metal coating, reflective to long-wave heat radiation, deposited on said foil carrier, wherein a plastic foil cut apart into the two sets of strips (15, 16), having longitudinal axes orthogonal to each other, is joined into a mat (FIG. 3) by means of interweaving said orthogonal sets so as to expose on a first side of said device one face of each of said strips at first alternating portions thereof, and to expose on a second side of said device the opposite face of said strip at second alternating portions of said strip.

4. A heat-retention device as defined by claim 3, characterized in that the strips (15, 16) have a width of approximately 3 to 15 mm.

5. A heat-retention device as defined by claim 3 or 4, characterized in that the strips (16) of the coated plastic foil are woven into a wide-mesh fabric curtain (17) (FIG. 4).

6. A heat retention device as defined by claim 3, wherein the foil strips have a width of approximately 3 to 15 mm.

7. A heat retention device as defined by claim 3, wherein each of said alternating portions is substantially rectangular in configuration.

8. A heat retention device as defined by claim 9, wherein the foil strips have a width of approximately 3 to 15 mm.

9. A heat retention device comprising a plastic foil carrier transparent to visible light and subdivided into strips (15,16), said strips being separated by peripheral zones (18), to alter its mechanical properties, an atomized metal coating, reflective to long-wave heat radiation, deposited on said foil carrier, and a wide-mesh fabric curtain (17) interlaced with said foil strips, wherein (FIG. 4)

the plastic foil strips (15,16) and the curtain (17) are secured together in the peripheral zones (18).

10. A heat retention device as defined by claim 9, wherein the foil strips are welded to the curtain.

11. A heat retention device as defined by claim 9, wherein the foil strips are glued to the curtain.

12. A heat retention device as defined by claim 9, wherein the foil strips are sewn to the curtain.

13. A heat retention device as defined by claim 9, wherein each of said peripheral zones is substantially rectangular in configuration.

* * * * *